US006038701A

United States Patent [19]

Regan

[11] Patent Number: 6,038,701

[45] Date of Patent: Mar. 21, 2000

[54] PROTECTIVE HOCKEY UNDERSHIRT

[76] Inventor: Paul Regan, 81 Colonel Betram Road, Brampton, Ontario, Canada, L6Z 4T6

[21] Appl. No.: 09/178,419

[22] Filed: Oct. 26, 1998

[51] Int. Cl.[7] ..... A41D 13/00; A41B 1/16

[52] U.S. Cl. ..... 2/125; 2/115; 2/123; 2/468; 2/910

[58] Field of Search ..... 2/455, 115, 113, 2/123–129, 468, 247, 69, 16

[56] References Cited

U.S. PATENT DOCUMENTS

| | | | |
|---|---|---|---|
| D. 329,508 | 9/1992 | Fair . | |
| 3,945,042 | 3/1976 | Lobo . | |
| 3,991,420 | 11/1976 | Savarino . | |
| 4,084,264 | 4/1978 | Marion . | |
| 4,195,362 | 4/1980 | Rolando . | |
| 4,213,202 | 7/1980 | Larry . | |
| 4,441,211 | 4/1984 | Donzis . | |
| 4,507,801 | 4/1985 | Kavanagh et al. . | |
| 4,590,662 | 5/1986 | Wolfe et al. . | |
| 4,608,716 | 9/1986 | Brumfield . | |
| 4,686,710 | 8/1987 | Marston et al. . | |
| 4,700,403 | 10/1987 | Vacanti . | |
| 4,756,026 | 7/1988 | Pierce, Jr. . | |
| 4,756,027 | 7/1988 | Buenos et al. | 2/125 |
| 4,821,339 | 4/1989 | Fair . | |
| 4,985,934 | 1/1991 | Perry | 2/125 |
| 5,052,052 | 10/1991 | Gilford et al. . | |
| 5,325,537 | 7/1994 | Marion . | |
| 5,337,418 | 8/1994 | Kato et al. . | |
| 5,361,410 | 11/1994 | Sigl . | |
| 5,388,371 | 2/1995 | Sessoms | 2/115 |
| 5,781,935 | 7/1998 | Bassett et al. . | |

*Primary Examiner*—Gloria M. Hall
*Assistant Examiner*—Tejash Patel

[57] ABSTRACT

A hockey shirt with a lower trunk opening, a neck opening and a neck guard associated with the neck opening. The neck guard includes a neck surrounding band of fabric, and a releasible attachment for changing the diameter of the neck guard to suit the needs of the wearer. In one embodiment the shirt includes sleeves, with cuff assemblies. The cuff assemblies include a slash guard retaining pocket and an elasticizing means, which in the preferred embodiment is the sleeve cuff itself.

13 Claims, 1 Drawing Sheet

PROTECTIVE HOCKEY UNDERSHIRT

FIELD OF THE INVENTION

This invention relates generally to the field of sports equipment, and more particularly to hockey equipment of the sort worn by a player to provide comfort and protection during the rough and tumble play of the game of hockey.

BACKGROUND OF THE INVENTION

Hockey is a sport played on ice. The game is played with a hard rubber puck, and metal or wooden shafted sticks. Physical contact between players from opposing teams and their sticks, and even occasionally between players from the same teams, is an integral part of the game of hockey. Hockey is played by adults, as well as by many children and has variations, including ringette, shinny hockey and the like.

Because of the physical contact, and, because the game is played on a slippery ice surface, it is not always possible to predict or control how the contact is made. Therefore, hockey equipment is generally designed to prevent injury when such physical contact is made between players, sticks and opponents. This protective equipment includes helmets, shoulder pads, shin pads, elbow pads and the like.

As the game has evolved, better and additional protective equipment has been developed which facilitates the playing of the game of hockey. The new protective equipment is lighter, stronger and offers more protection. However, it may be more awkward to use.

For example, more recently, there has been a tendency to use gloves with a shorter cuff on the sleeve. Typically, the cuff of hockey glove is reenforced, to protect the arm of the wearer against inadvertent slashing by an opponent. However, the longer cuff makes movement of the hand more difficult, and thus inhibits smooth stick handling or shooting. Therefore, a hockey glove with a shorter cuff has become preferred. However, the short cuff leaves a section of the wrist exposed and vulnerable to a slash from an opponent's hockey stick. Consequently, small protective wrist guards have been developed which can be applied to the wrist in a manner similar to elbow pads. To apply the slash guard requires an additional dressing step, and further belts or straps.

Additionally, there have been several instances of extremely grievous injuries caused when an opponent's skate makes contact with the neck of a hockey player. The skates include metal blades which are sharp, and can cause grievous cuts. Therefore, it is now mandatory in many hockey leagues, especially for children, that the players wear neck guards. These neck guards typically consist of rip proof nylon, with associated padding, to prevent a skate blade from cutting into the neck of a wearer. Again, to wear the neck guard requires an additional dressing room step. However, these devices, while mandatory are easily lost or misplaced by children, leading to aggravation and frustration for children and parents alike.

Therefore, while providing more protection and thus being better for safety, a problem with these devices is that each needs to be applied in a separate dressing step, or removed in a separate undressing step, which is time consuming, awkward, and less than satisfactory. Additionally, these devices tend to become sweat filled over time, and, are not easily washed. In this way, they can become unhygienic.

SUMMARY OF THE INVENTION

What is desired is a simple and easy method for applying and removing these protective hockey devices during the dressing or undressing step of a hockey player. In addition, what is desired is a way for the hockey player to simply and easily clean these devices to prevent them from becoming unhygienic. Further what is desired is a way to improve the comfort of the wearer, such as by reducing chaffing itching and other discomforts that might arise where straps and pads are applied directly to the skin of a hockey player. Lastly, it is desired to provide a garment system which can be used by small children which keeps the various equipment components together to prevent unwanted misplacement and loss of critical elements of protective wear. Therefore, there is provided according to a first aspect of the present invention an undershirt for use by hockey players, the undershirt comprising:

a torso portion with a lower trunk opening;

a pair of sleeves attached to the torso portion;

a head opening; and a sleeve cuff assembly on said sleeves distal from said torso portion, said sleeve cuff assembly including an fastening means wherein said fastening means is sufficiently adjustable to allow a slash guard to be selectively positioned on a wrist of said hockey player during a dressing step and securable to securely retain a slash guard in said sleeve cuff assembly during play.

According to a second aspect of the present invention, there is provided an undershirt for use by hockey players, said undershirt comprising:

a torso portion;

openings for arms of a wearer;

a lower trunk opening; and the head opening, said head opening including an integral neck cuff assembly including a neck surrounding band of fabric, a neck guard mounted to said neck surrounding band of fabric, and, an adjustable, releasable attachment means, to permit said neck guard to be securely positioned around the neck of the wearer during play.

Most preferably, both aspects of the present invention are combined into a single garment, which reduces a plurality of dressing room steps of dressing and undressing to one step.

DETAILED DESCRIPTION OF THE PREFERRED EMBODIMENTS

Figure 1:
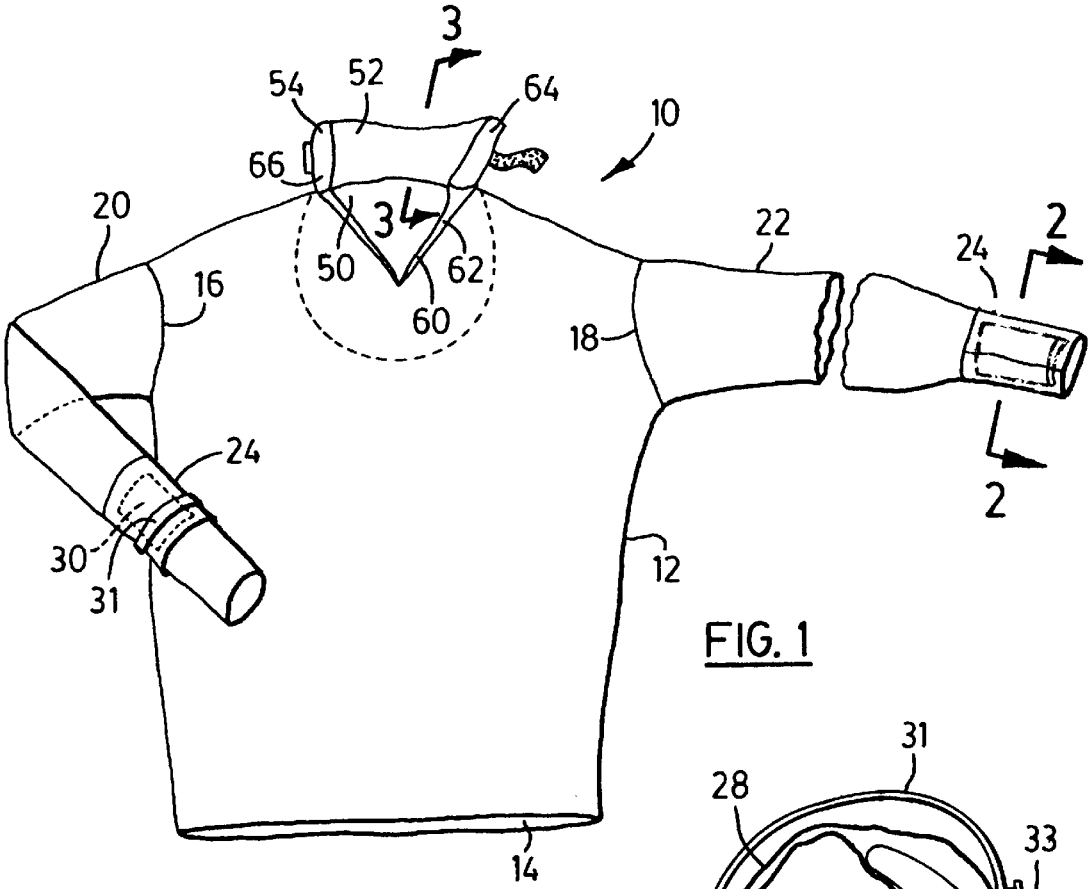
FIG. 1 is a back view of a hockey undershirt according to the present invention.
Figure 2:
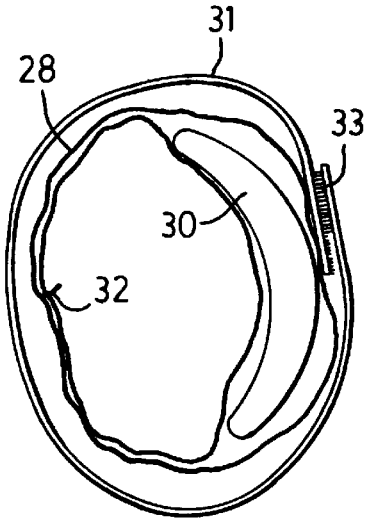
FIG. 2 is a cross-sectional view along line 2—2 of FIG. 1.
Figure 3:
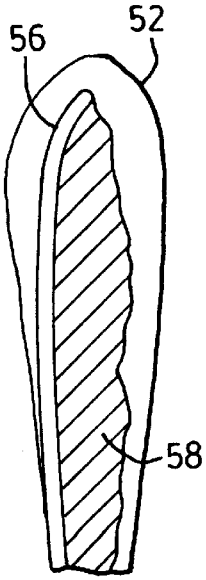
FIG. 3 is a cross-sectional view along line 3—3 of FIG. 1.
Figure 4:
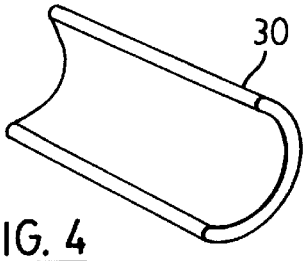
FIG. 4 is isometric view of a wrist guard.
Figure 5:
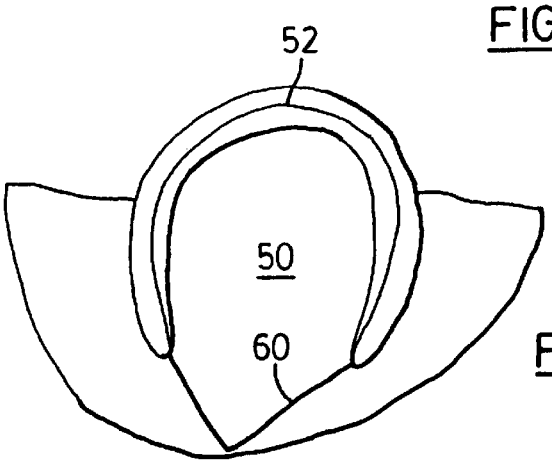
FIG. 5 is a view from above of a neck guard on a shirt according to the present invention.

FIG. 1 shows a hockey undershirt indicated generally at 10, which includes a torso portion 12. The torso portion 12 has a lower trunk opening 14 and a pair of sleeve openings 16 and 18. In the embodiment of FIG. 1, attached to the sleeve opening 16, 18 are two sleeves 20, 22 respectively. On each sleeve 20, 22 distal from the sleeve openings on the torso portion is located a wrist cuff assembly 24.

The wrist cuff assembly 24 is comprised of a folded over portion of fabric 28, which forms a chamber or slot to capture a wrist guard 30. Formed in the cuff portion 28 is a seam 32 which joins the ends of the fabric 28 to the sleeve thereby forming a closed chamber or slot to contain the wrist guard 30. Alternately, the chamber could be openable, like a pocket, to permit the wrist slash guard 30 to be inserted and removed as needed.

The fabric 28 forming the wrist cuff assembly 24 most preferably includes material which is sufficiently resilient to allow the slash guard 30 to be selectively positioned on the wrist of a wearer when in said open or closed chamber or slot. It will be appreciated by those skilled in the art that the material may take any number of forms. The needed resiliency might take the form of the weave of the fabric 28 itself, which permits a certain resiliency in the actual fabric to hold the cuff 24 and thus the slash guard 30 tightly around the wrist of a wearer. Alternately, the material might comprise elasticized threads which are woven into the fabric of the sleeve itself in a known manner to produce an elasticized chamber or slot in the cuff. Additionally, the resiliency might be provided by any other elasticized device which extends around the wrist guard 30, and which therefore provides a seating force to hold the wrist guard 30 in place on the wrist of a wearer such as internal or external elastic or strap members to secure the wrist guard 30 in place. For example, although less preferred the sleeve cuff assemblies could optionally include attachment strips (shown as 31), analogous to sock garters which could be made adjustable by hook and loop pile fasteners 33.

It will also be appreciated that each player will want to attach the wrist guards to different portions of their wrists, depending upon their age, the type of gloves they have, and the like. Thus, the wrist cuff assembly of the present invention needs to be positioned beyond the overhanging end of the protection cuff of the gloves, part way along the forearm. As such the pocket on slot needs to be positioned higher along the forearm than a conventional cuff of a shirt. This can be accomplished by either making the shirt sleeves shorter than would be typically required and forming the cuff at the end (see right side of FIG. 1), or, making the shirt sleeves the usual length, but forming the chamber or slot about midway between the elbow and wrist (see left side of FIG. 1).

While many different types of retaining means are contemplated by the present invention, it will be appreciated by those skilled in the art that the important aspect is to include the wrist slash guard 30 being made of a stiff plastic material or the like to protect the wrist area of the wearer into the cuff 28 of the shirt, in a way that the wrist guard 30 is kept in its protective position during play. Thus, the straps need not even be elastic, provided that cuff can open enough to receive the hand through the sleeve when the undershirt 10 is being put on, and then close enough to secure the wrist guard 30 on the wrist and keep the wrist guard in place during the rough and tumble of play. A Velcro™, loop and pile fastener across the cuff of the sleeve would also suffice.

The present invention also contemplates the cuff 28 of the shirt being made in the form of a pocket, which can releasably accommodate the wrist slash guard 30. In other words, in this further embodiment it would be possible to remove the wrist slash guard 30 from the cuff 28 to replace or otherwise remove the wrist protectors. However, this is less preferred because the more separate pieces there are, the more likely there will be a component lost or misplaced. Thus, the present invention contemplates a cuff assembly having a pocket which will accept a wrist guard 30, or, having the wrist guard 30 actually in the pocket, either permanently or removably.

It can further be appreciated the present invention provides an additional benefit to the player, in terms of comfort. Often the pads, like elbow pads, that are provided for hockey are made sturdy to withstand the blows and impacts of the game. Typically elbow pads are provided with straps that are intended to be secured across the limb of the player. In many cases the straps are rough and when tightened can bite into the skin of the player and thus can cause chaffing and the like. Also, the pads can be a source of more mild irritation such as itching or the like. Thus providing an undershirt as in the present invention lets the elbow pads and shoulder pads be attached on the outside of the sleeves, which the prevents and lessens itching and chaffing. Thus most preferable the present invention is made from a soft breathable fabric such as cotton or cotton/synthetic blends or the like.

Turning to the second aspect of the present invention, there is provided a neck opening 50 for the head of the wearer. Around the neck opening 50 is a strip of material 52. Attached to this strip of material 52 is a neck guard 54. The neck guard 54 is of the type having a cut-proof wall portion 56 and padding 58. Most preferably the strip of material 52 is of the form of a closed tube into which the neck guard 54 fits and is retained. The material should be skin compatible and washable. As with the wrist slash protector, the closed tube may be made openable. While the neck guard 54 may be removable from the closed tube, it is preferred if it is integrally mounted into the strip 52.

To permit the neck opening 50 to accommodate heads of different sizes, a slit, is formed in the preferred embodiment as shown at 60 on the back or rear side of the undershirt 10. Most preferably this slit 60 is V-shaped, with an appropriate finished edge 62. In the most preferred embodiment, a hook and loop pile fastener, of the Velcro™ type is used to connect the two ends 64, 66 of the neck guard 54. This provides an adjustable closure to permit the wearer to snug the neck guard 54 up around the neck, while allowing the neck opening 50 to be large enough to have the head pass there through. Having the slit at the back protects the more vulnerable throat portion with a continuous cover.

Of course, many alternate fastening devices could be used, apart from Velcro™ to close the V-shaped slit. Snap fasteners, buttons, and elasticized bands could also be used to provide a snug fit for the neck. However, Velcro™ is preferred, because of its ease of use and the secure attachment that is made. It will appreciated that around the neck of a wearer it is important to have a snug fit, and yet one which does not exert any constricting force around the neck. Therefore, any elasticized bands that are used must be provided with sufficient slack to prevent the neck band from being cinched around the neck of the user and cutting off blood or air circulation. Even slight pressure can be uncomfortable.

An example of an alternate form of the present invention, could be to make the material stretch, analogous to an ordinary shirt, to permit the neck guard 54 to be stretched out of position over the head, and then closed in again around the neck of the wearer when the head has passed through the neck opening 50, without the use of a V-shaped slit 60. However, for ease of construction and use the V-shaped lit 60 is preferred. Also, for safety, it is preferred to provide some positive means to secure the neck guard 54 to a specific neck accommodating diameter, without relying upon the inherent resiliency of the shirt material.

Another alternate form of this present invention is to extend the rip-proof nylon down over the front of the chest in a manner similar to a bib. This extends the protection over a larger area and protects not only the throat, but the upper chest area as well. The bib portion could be made of various sizes, depending upon how much protection was desired.

It can now be appreciated that the most preferred form of the present invention is to combine both aspects into one undershirt, such an undershirt provides a single garment, that includes essentially built-in protection. In this way, three dressing room steps are reduced to a single one, all that is needed is to pull the undershirt on over the head and arms and to attach the strap of the neck guard 54. When removing the undershirt it is just as easy. Further, the whole undershirt can be easily put into the wash, meaning that the sweat accumulated in either the wrist slash guard 30 or neck guard 54 can be easily washed away. In this way this equipment can be kept clean and fragrant.

Various modifications and alterations are possible to the form of the invention, without departing from the scope of the broad claims as attached hereto. In particular, while reference has been made to Velcro™, and elasticizing means, various other attachment arrangements are possible, without departing from the broad scope of the present invention.

I claim:

1. An undershirt for use by hockey players, said undershirt comprises:

a torso portion;

openings for arms of a wearer;

a lower trunk opening; and a head opening, said head opening including an integral neck cuff assembly including a band of fabric for at least substantially surrounding the neck of the user, a neck guard mountable to said band of fabric said neck guard being openable to accommodate the head of a user there through and, an adjustable, releasable attachment means, to permit said neck guard to be positioned on the neck of the wearer.

2. An undershirt for use by hockey players as claimed in claim 1 wherein said neck protector includes a layer of rip proof nylon.

3. An undershirt for use by hockey players as claimed in claim 1 wherein said undershirt includes a V-shaped slot formed as part of the head opening to permit the undershirt to be placed over the head of a user.

4. An undershirt for use by hockey players as claimed in claim 3 wherein said V-shaped slot includes a finished edge.

5. An undershirt for use by hockey players as claimed in claim 1 wherein said neck protector is integrally attached to said undershirt.

6. An undershirt for use by hockey players, the undershirt comprising:

a torso portion with a lower trunk opening;

a pair of sleeves attached to the torso portion;

a sleeve cuff assembly on each of said sleeves distal from said torso portion, said sleeve cuff assembly including an fastening means wherein said fastening means is sufficiently adjustable to allow a slash guard to be selectively positioned on a wrist of said hockey player during a dressing step and securable to securely retain a slash guard in said sleeve cuff assembly during play and a head opening, said head opening including an integral neck cuff assembly including a band of fabric for at least substantially surrounding the neck of the user, a neck guard mountable to said band of fabric said neck guard being openable to accommodate the head of a user there through and, an adjustable, releasable attachment means, to permit said neck guard to be positioned on the neck of the wearer.

7. An undershirt for use by hockey players as claimed in claim 6 wherein at least one of said slash guards and said neck guard is integrally attached to said under garment.

8. An undershirt for use by hockey players as claimed in claim 6 wherein as least one of said slash guards and said neck guard is removable from said undershirt.

9. A shirt as claimed in claim 6 wherein said cuff assembly includes a pocket to retain said slash guards in place.

10. A shirt as claimed in claim 6 wherein said pocket is an openable pocket.

11. An undershirt for use by hockey players as claimed in claim 6 wherein said neck protector includes a layer of rip proof nylon.

12. An undershirt for use by hockey players as claimed in claim 6 wherein said undershirt includes a V-shaped slot formed as part of the head opening to permit the undershirt to be placed over the head of a user.

13. An undershirt for use by hockey players as claimed in claim 6 wherein said neck protector is integrally attached to said undershirt.

* * * * *